US007100915B2

(12) United States Patent
Lee et al.

(10) Patent No.: US 7,100,915 B2
(45) Date of Patent: Sep. 5, 2006

(54) PAPER FEEDING APPARATUS OF IMAGE FORMING DEVICE

(75) Inventors: Yong-duk Lee, Gunpo (KR); Sang-jin Bae, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 22 days.

(21) Appl. No.: 10/757,997

(22) Filed: Jan. 16, 2004

(65) Prior Publication Data

US 2004/0161280 A1 Aug. 19, 2004

(30) Foreign Application Priority Data

Jan. 18, 2003 (KR) ..... 10-2003-0003516

(51) Int. Cl.
*B65H 1/08* (2006.01)

(52) U.S. Cl. ..... 271/147; 271/162

(58) Field of Classification Search ..... 271/162, 271/127, 147, 117; 347/104
See application file for complete search history.

(56) References Cited

U.S. PATENT DOCUMENTS 4,050,687 A * 9/1977 Spence-Bate ..... 271/3.1
4,083,553 A * 4/1978 Beck et al. ..... 271/4
4,147,341 A * 4/1979 Wurscher et al. ..... 271/122
5,213,427 A 5/1993 Grosse et al.
5,573,235 A * 11/1996 Asai ..... 271/121
5,992,993 A * 11/1999 Kiyohara et al. ..... 347/104
6,042,103 A * 3/2000 Yraceburu et al. ..... 271/118
6,095,515 A * 8/2000 Kiyohara et al. ..... 271/161
6,224,051 B1 * 5/2001 Nakayama et al. ..... 271/115
6,494,633 B1 12/2002 Crosby et al.

FOREIGN PATENT DOCUMENTS

EP 0675414 A2 10/1995
JP 2-70625 * 3/1990
JP 3-272922 12/1991
JP 5-286580 11/1993
JP 5-294472 11/1993

* cited by examiner

*Primary Examiner*—Kathy Matecki
*Assistant Examiner*—Thomas Morrison
(74) *Attorney, Agent, or Firm*—Staas & Halsey LLP

(57) ABSTRACT

A paper feeding apparatus of an image forming device having a feeder opening and closing unit to automatically rotate a paper feeder between a storing position and a paper feeding-standby position selectively employing a driving source driving a transporting unit with a pickup roller and a feed roller. The paper feeding apparatus automatically opens the paper feeder to the paper feeding-standby position when the image forming device is used, and automatically closes the paper feeder to the storing position to minimize space when the image forming device is not in use, thereby accommodating a user and minimizing a size of the image forming device.

23 Claims, 15 Drawing Sheets

PAPER FEEDING APPARATUS OF IMAGE FORMING DEVICE

CROSS-REFERENCE TO RELATED APPLICATIONS

This application claims the benefit of Korean Patent Application No. 2003-3516, filed on Jan. 18, 2003, in the Korean Intellectual Property Office, the disclosure of which is incorporated herein by reference.

BACKGROUND OF THE INVENTION

1. Field of the Invention

The present invention relates to a paper feeding apparatus of an image forming device such as a laser printer, a copier, and an ink jet printer, and more particularly, to a paper feeding apparatus of an image forming device, which is capable of automatically opening a paper cassette into a paper feeding-standby position when the image forming device should be used, and automatically closing the paper cassette into a space-minimized position when the image forming device is not in use.

2. Description of the Related Art

FIGS. 1 and 2 show an ink jet printer as an image forming device. Generally, the ink jet printer has an ink cartridge 1 having a print head to jet ink to form an image on a sheet of paper P, a carrier 2 to move the ink cartridge 1 right and left, and a paper feeding apparatus 3, 4, 5, 6, 7, 8 to feed the sheet of paper P into the printer.

The paper feeding apparatus 3, 4, 5, 6, 7, 8 is composed of a paper cassette 3 to stack sheets of paper P, a pickup roller 4 to pick up a sheet of paper P, a paper sensor (not shown) to sense the sheets of paper P, a feed roller 5 to align a leading end of the picked-up paper P and transport it, a register sensor 6 to sense a timing driving the feed roller 5 to allow the feed roller 5 to align the leading end of the picked-up paper P, a guide 7 to guide the feed of paper P, and a discharging roller 8 and a discharging backup roller 12 to discharge the paper P.

The operation of the ink jet printer constructed as above will be explained as follows.

According to a print command from a computer, the pickup roller 4 picks up a sheet of paper P from the paper cassette 3, and transports it toward the feed roller 5 along the guide 7.

At this point, the register sensor 6 installed in front of the feed roller 5 is actuated by the paper P, and thereby a controller (not shown) calculates how long it takes the leading end of paper P to move from the register sensor 6 to an entrance of the feed roller 5, and then drives the pickup roller 4 for the calculated time, that is, until the leading end of paper P is curled and aligned at a nip between the feed roller 5 and a backup roller 10.

After the leading end of paper P is aligned, the controller stops the pickup roller 4, and at the same time, drives the feed roller 5 to move the paper P into a printing area under a nozzle 1*a* of the print head of the ink cartridge 1.

When the paper P is moved into the printing area, the carrier 2 moves the ink cartridge 1 right and left, so that the ink cartridge 1 can jet ink through the nozzle 1*a* of the print head to perform the printing operation.

When the printing is completed as above, the discharging roller 8 discharges the paper P, and the printing operation is finished.

But in such a conventional ink jet printer, since the paper cassette 3 of the paper feeding apparatus is integrally connected with a main body of the printer, there is a problem that a space for installing and mounting the paper cassette 3 is required, thereby increasing a size of the printer.

To solve the problem, as is shown in FIGS. 3A and 3B, there has been proposed another image forming device having a paper cassette 3' which is mounted on a main body 20 of the printer when in use, and separated from the main body 20 and stored in a separate space when not in use.

This image forming device has an advantage that when the paper cassette 3' is separated from the main body 20 and stored in the separate space, a size of the printer is reduced. But it is troublesome that for use, the paper cassette 3' must be mounted on the main body 20.

Also, when the paper cassette 3' is separated from the main body 20 and stored in the separate space, the paper cassette 3' can be lost or damaged due to poor management or limitation of space.

To solve these problems, as is shown in FIGS. 4A and 4B, there has been proposed still another image forming device having a paper cassette or unit 3" which is hinged on a front portion or a side portion of a main body 20' of the printer. The hinged paper cassette 3" is manually opened and closed, rather than being mounted on and separated from the main body 20'.

But with this image forming device, it is troublesome that for use, a user must manually open and close the paper cassette 3". And as an additional problem, when sheets of paper P remain in the paper cassette 3" after printing, the remaining sheets of paper must be stored in a separate space when the paper cassette 3" is closed.

SUMMARY OF THE INVENTION

The present invention has been devised to solve the above and/or other problems, so it is an aspect of the present invention to provide a paper feeding apparatus of an image forming device, which is capable of automatically opening a paper cassette into a paper feeding-standby position when the image forming device is used, and automatically closing the paper cassette into a space-minimized position when the image forming device is not in use.

According to one aspect, the present invention provides a paper feeding apparatus of an image forming device, having: a main body; and a paper cassette, rotatably connected to the main body, automatically moved between a storage position and a paper feeding position, and storing paper in both the storage and paper feeding positions.

According to one aspect, the present invention provides a paper feeding apparatus of an image forming device, having: a main body; a paper cassette having a knockup plate, rotatably connected to the main body, and storing paper in a storage position and a paper feeding position; an actuator; and a carrier, engaging the actuator to selectively employ a driving source that drives a pickup roller and a feed roller to automatically move the paper cassette between the storage position and the paper feeding position, and engage a movement-transforming member transforming linear motion in a first direction to linear motion in a second direction perpendicular to the first direction, to move the knockup plate, to move the paper toward the feed roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
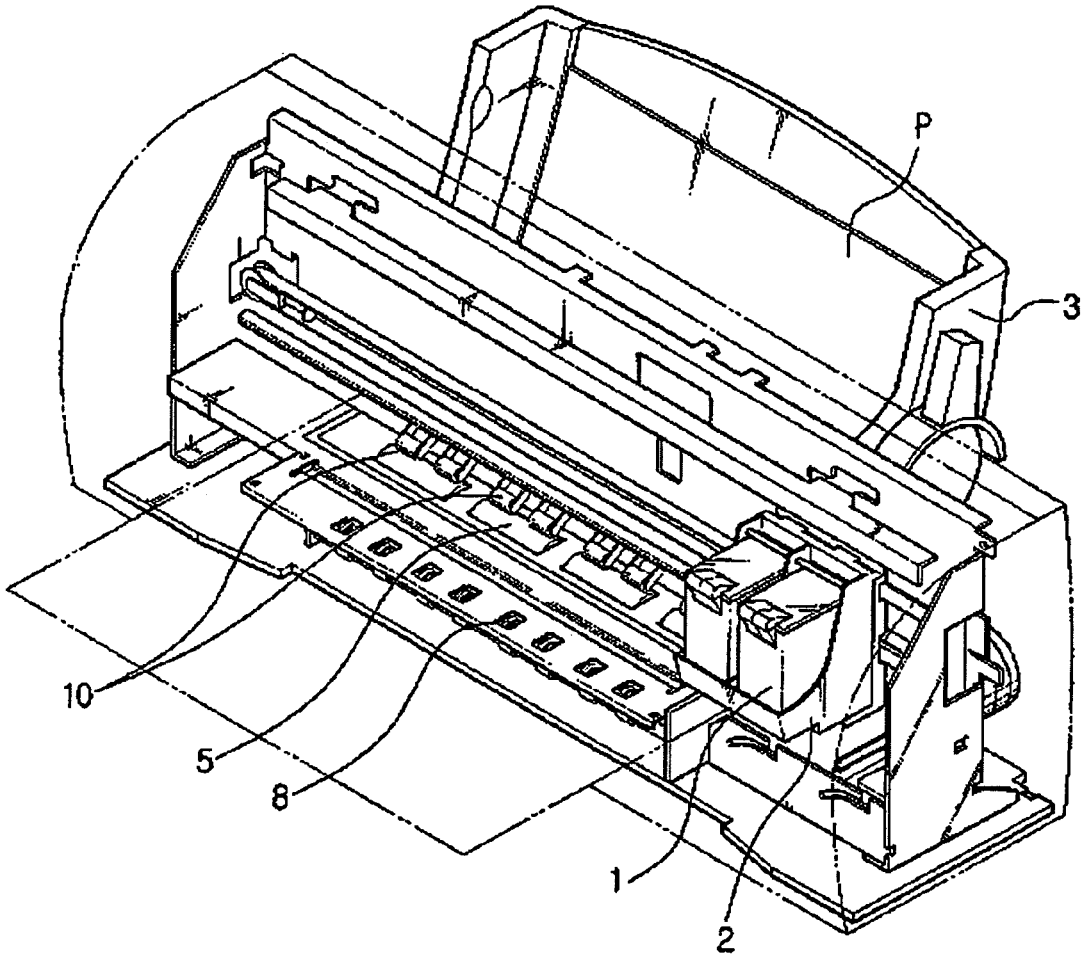
FIG. 1 (PRIOR ART)
FIG. 1 is a partial perspective view of a conventional ink jet printer.
Figure 2:
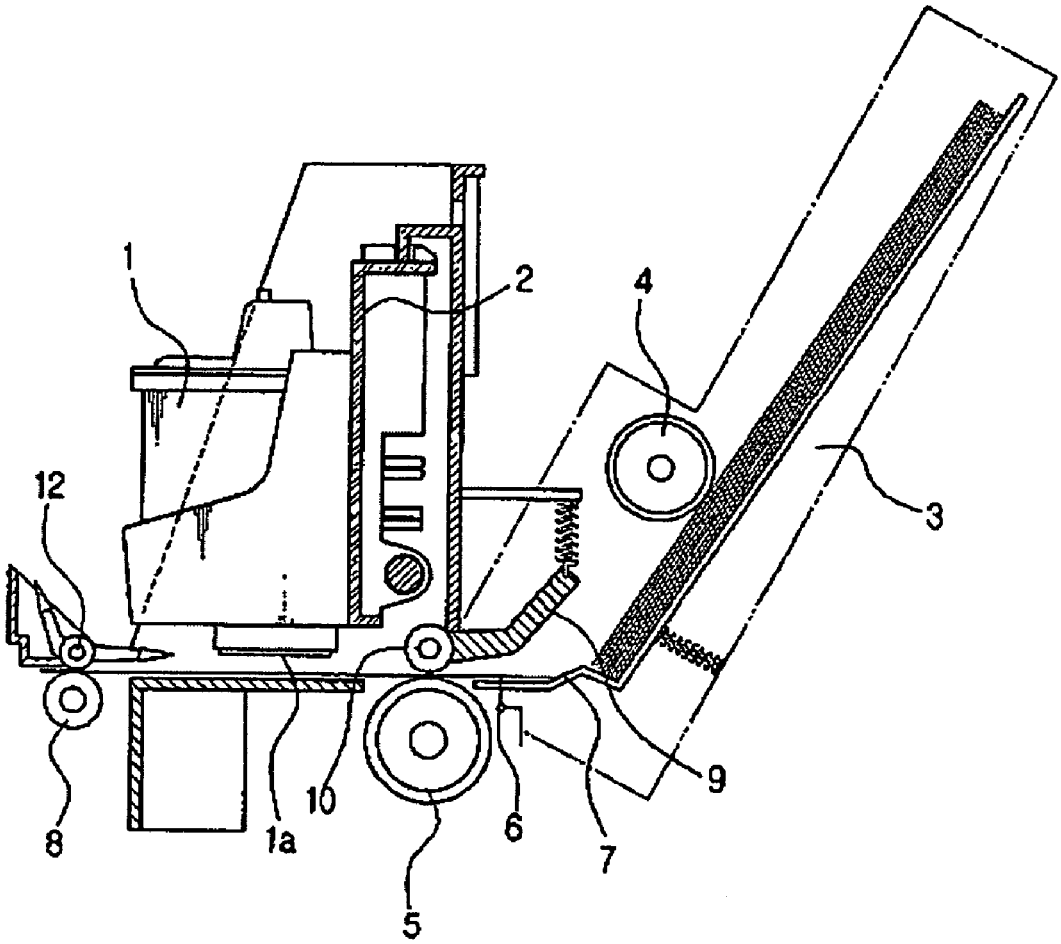
FIG. 2 (PRIOR ART)
FIG. 2 is a cross-sectional view of the ink jet printer of FIG. 1.
Figure 3A:
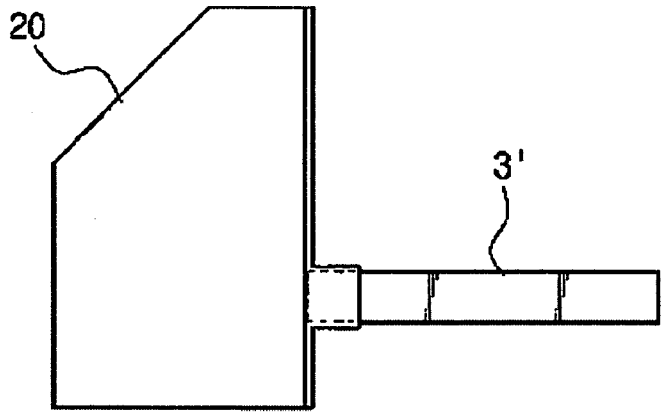
FIG. 3A (PRIOR ART)
FIGS. 3A and 3B are schematic side elevation views of a conventional image forming device having a detachable paper cassette.
Figure 3B:
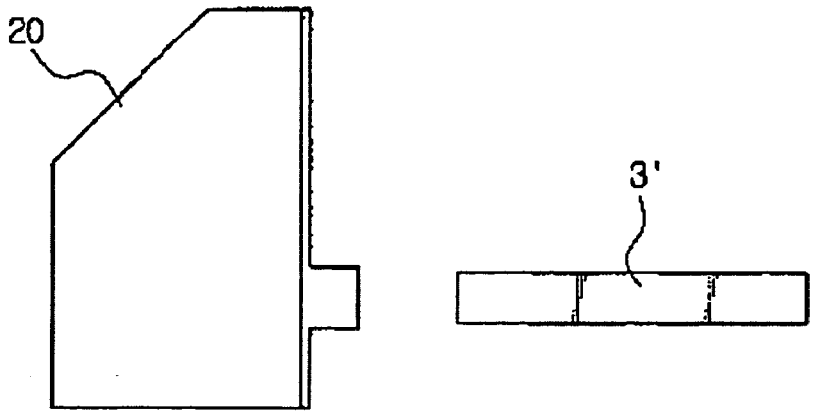
FIG. 3B (PRIOR ART)
Figure 4A:
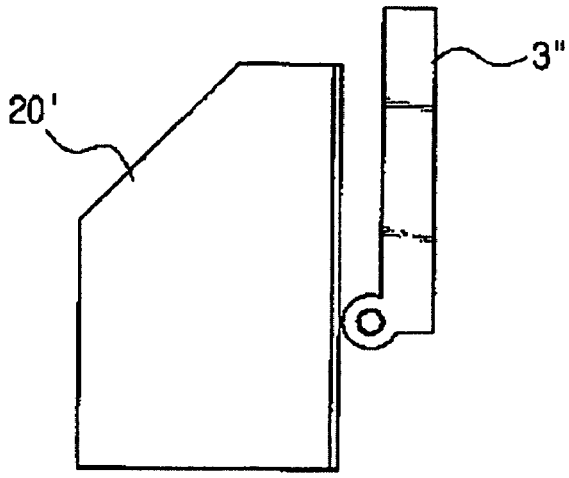
FIG. 4A (PRIOR ART)
FIGS. 4A and 4B are schematic side elevation views of a conventional image forming device having a hinged paper cassette.
Figure 4B:
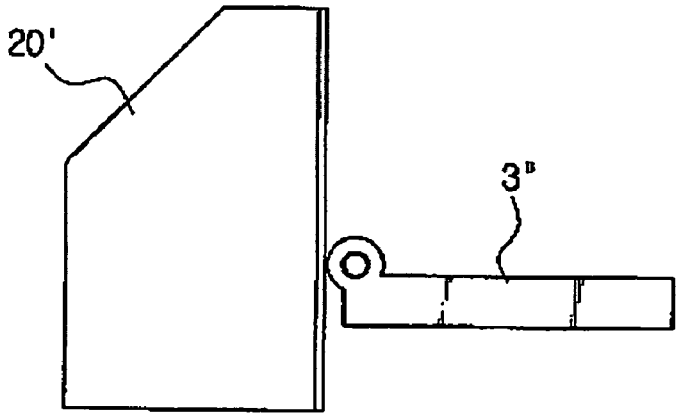
FIG. 4B (PRIOR ART)

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 5:
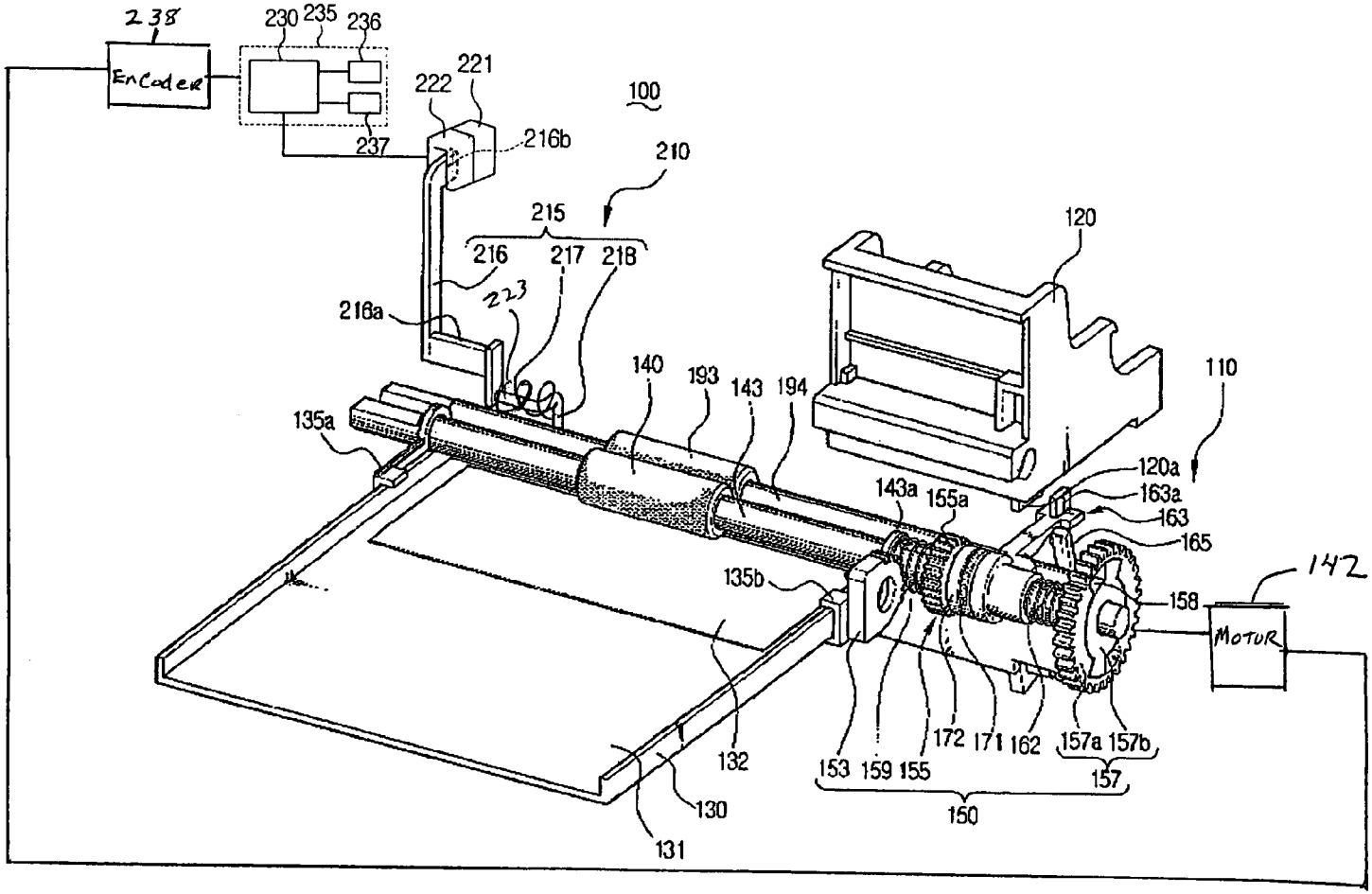
FIG. 5 is a perspective view of a paper feeding apparatus of an ink jet printer according to an embodiment of the present invention.

FIG. 5 shows a paper feeding apparatus 100 according to an embodiment of the present invention, which is used with an ink jet printer.

The ink jet printer in which paper feeding apparatus 100 is applied comprises a printing unit including an ink cartridge (not shown) having a print head with a nozzle (not shown) positioned thereon, and a carrier 120 having the ink cartridge mounted thereon. The carrier 120 is moved right and left by a carrier driving motor (not shown), so that the ink cartridge can perform the printing operation, moving together with the carrier 120.

The description about the constructions of the printing unit will be omitted here, as it is identical to that of the conventional ones that are described above with reference to FIG. 1, except that the carrier 120 has an actuating projection 120*a* positioned on an undersurface thereof to engage with a corresponding actuated projection 163*a* and thereby move the actuating lever 163 when the carrier 120 is moved right and left.

Figure 8A:
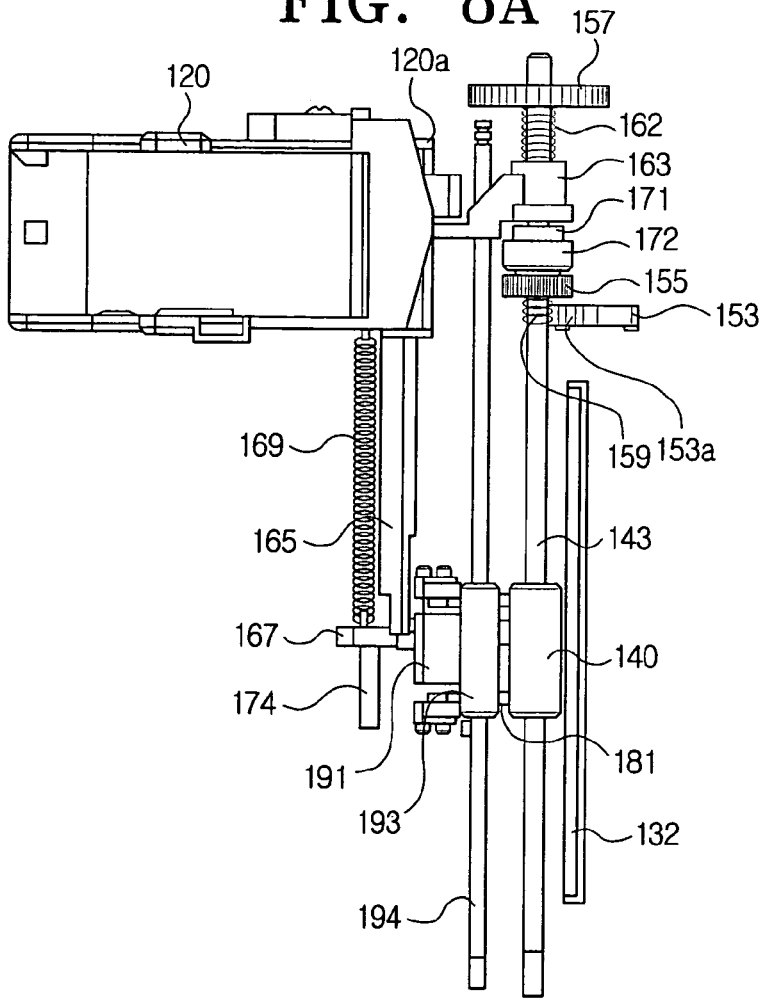
FIGS. 8A, 9A, and 10A are top plan views illustrating opening and closing operations of a paper cassette of the paper feeding apparatus of FIG. 5, and FIGS. 8B, 9B, and 10B are left side elevation views corresponding to the respective top plan views of FIGS. 8A, 9A, and 10A.

The paper feeding apparatus 100 comprises a frame (not shown) constituting a paper feeding path; a paper tray or cassette 130 rotatably disposed with respect to the frame and having a paper receiving space 131 to stack sheets of paper P (FIGS. 14A and 14B); a transporting unit 140, 145 having a pickup roller 140 to pick up a sheet of paper P stacked in the paper cassette 130, a feed roller 145 (FIGS. 14A and 14B) to transport the sheet of paper P picked up by the pickup roller 140, and a paper feed driving motor 142 connected with the pickup roller 140 and the feed roller 145 through a gear train to drive the pickup roller 140 and the feed roller 145; and a cassette opening and closing unit 110 to automatically rotate the paper cassette 130 between a storing position (FIGS. 8A and 8B) and a paper feeding-standby position (FIGS. 7, 10, 11, 12, and 13) using a driving force of the paper feed driving motor 142. The storing position is a position where the paper cassette 130 is in close contact with the frame to minimize an installation space of the printer, and the paper feeding-standby position is a position where the paper cassette 130 is separated from the frame, to allow the sheets of paper P to be picked up by the pickup roller 140.

Figure 6:
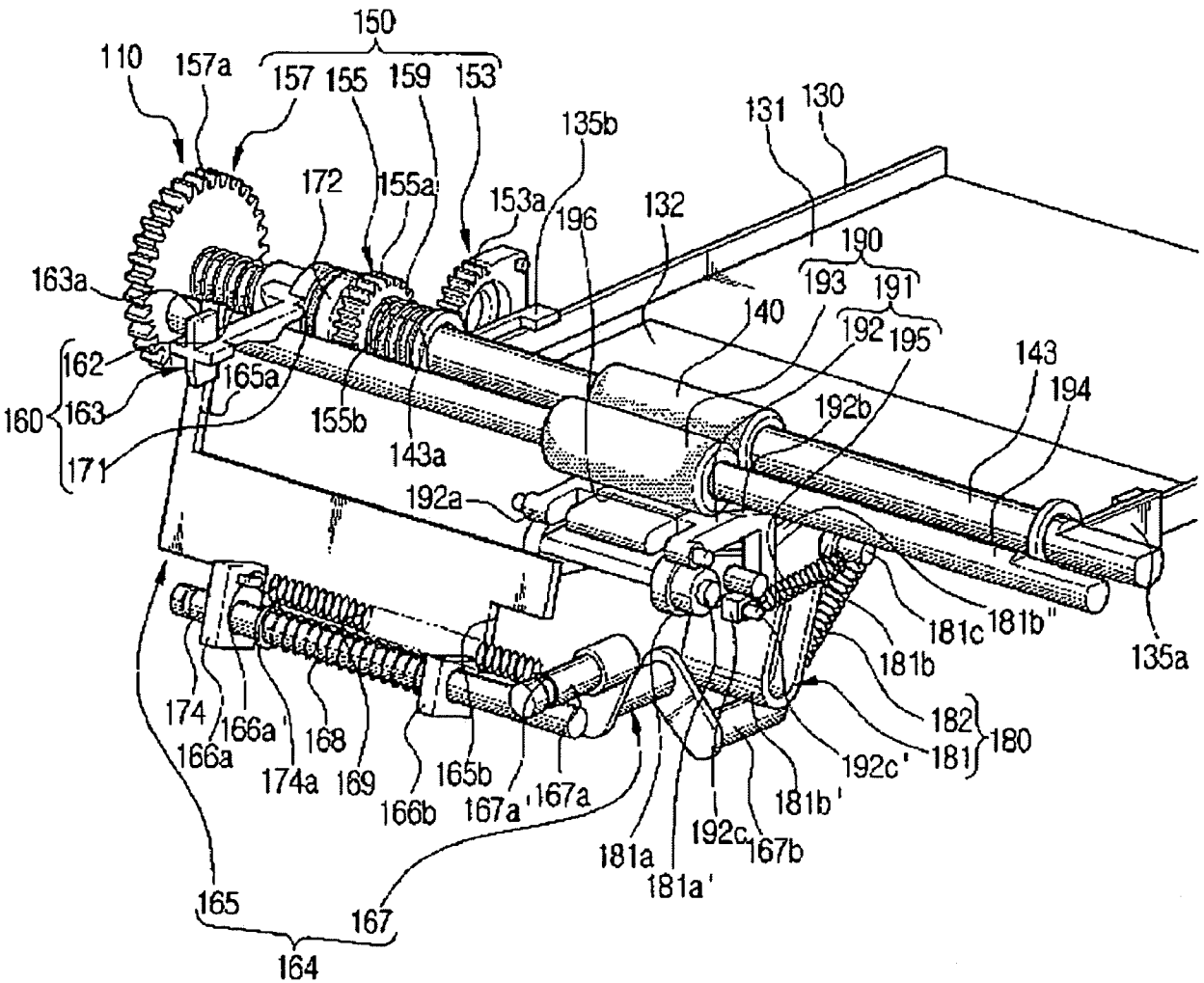
FIG. 6 is another perspective view of the paper feeding apparatus of FIG. 5.
Figure 7A:
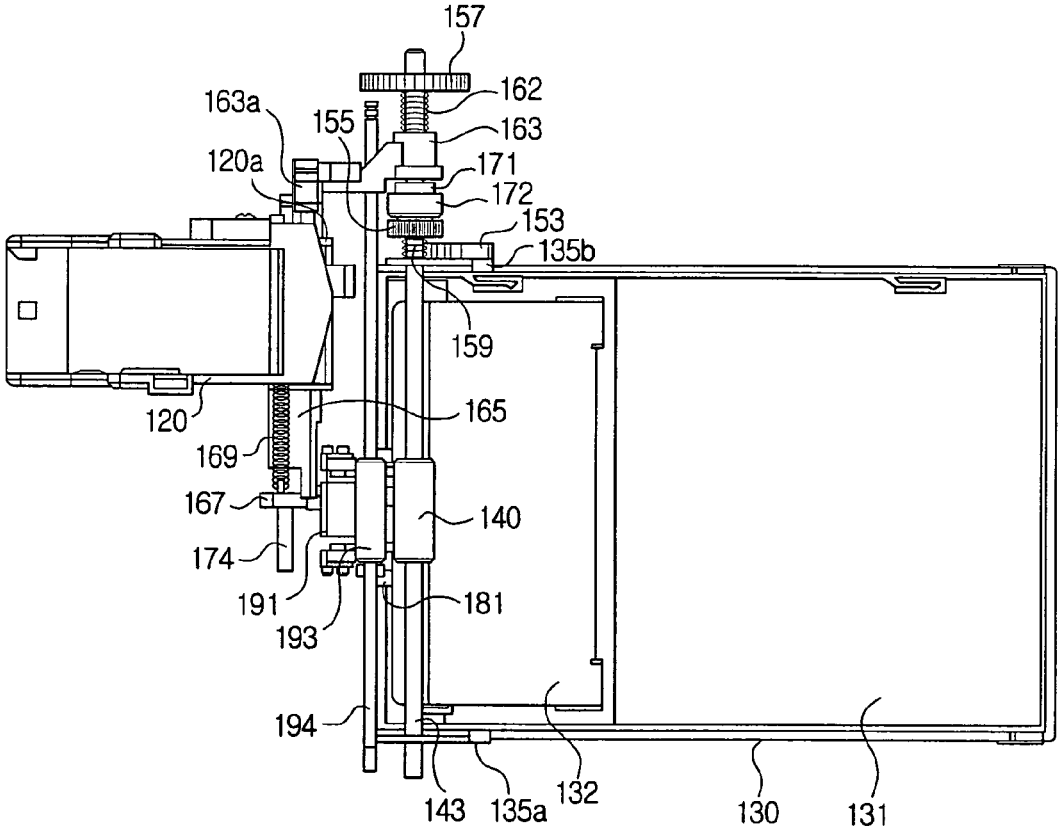
FIGS. 7A, 7B, and 7C are a top plan view, a left side elevation view, and a right side elevation view, respectively, of the paper feeding apparatus of FIG. 5.
Figure 7B:
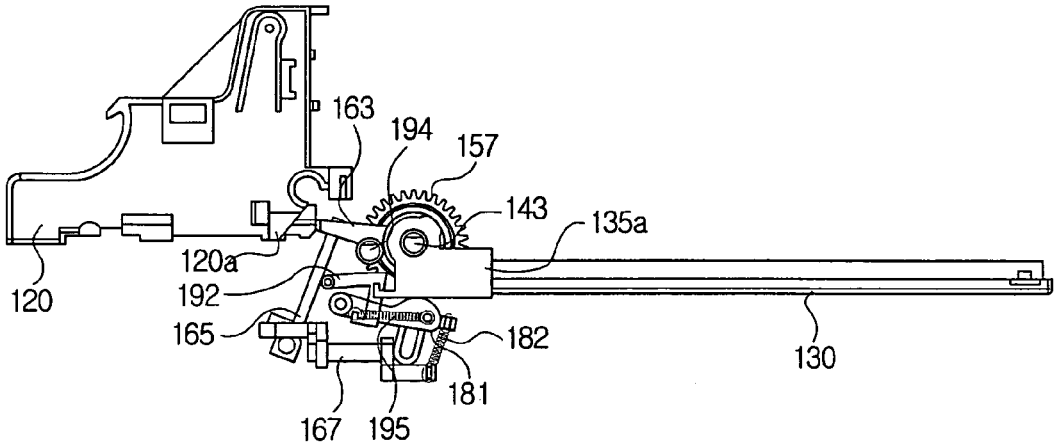
Figure 7C:
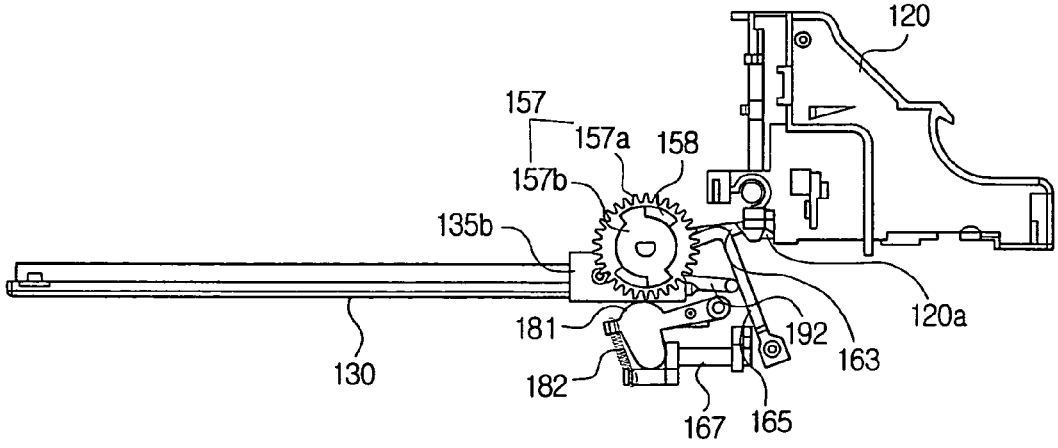

As is shown in FIGS. 5 and 6, the cassette opening and closing unit 110 comprises: a supporter 135 rotatably supporting one end of the paper cassette 130 positioned toward the pickup roller 140, on the frame; a power transmitter 150 selectively transmitting power from the paper feed driving motor driving the pickup roller 140 and the feed roller 145 to the supporter 135, to selectively rotate the paper cassette 130 between the storing position and the paper feeding-standby position; and an actuator 160 operating the power transmitter 150 to selectively transmit the power from the paper feed driving motor to the supporter 135.

The supporter 135 has first and a second hinge brackets 135*a* and 135*b* to rotatably support the one end of the paper cassette 130 on a shaft 143 of the pickup roller 140.

The power transmitter 150 is provided with a pickup roller driving gear 157 installed at one end of the shaft 143, a stop gear 153 positioned at the second hinge bracket 135*b*, a rotating gear member 155 movably installed on the shaft 143 to selectively engage the stop gear 153, and a first restoring member 159 restoring the rotating gear member 155.

Figure 14A:
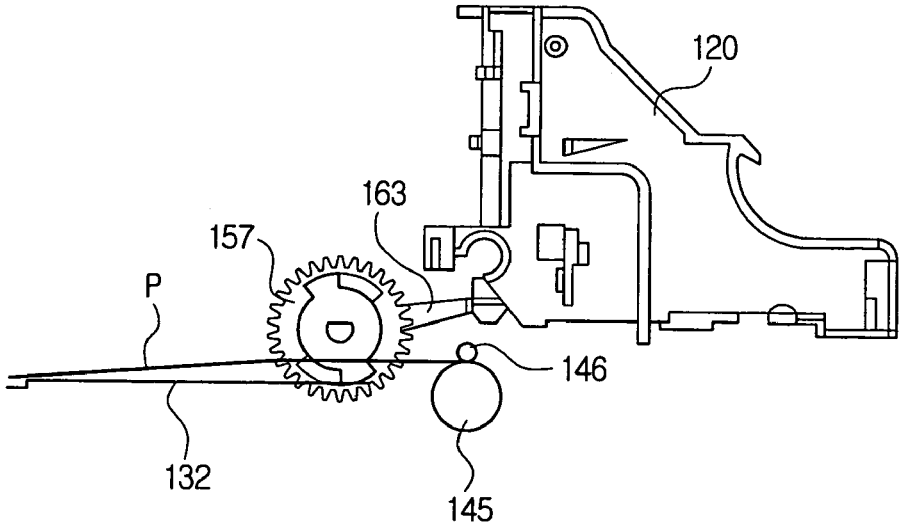
FIGS. 14A and 14B are right side elevation views illustrating the paper pickup operation of the paper feeding apparatus of FIG. 5.
Figure 14B:
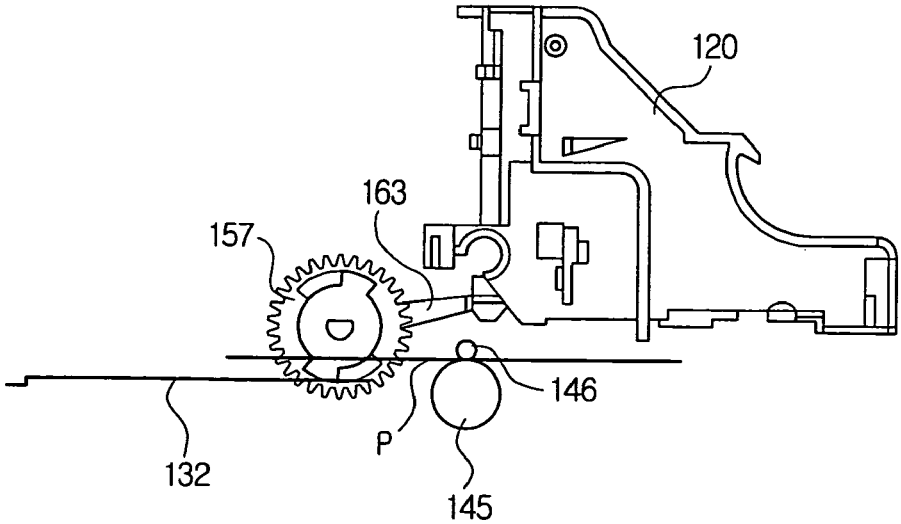

The pickup roller driving gear 157 has an outer gear 157*a* connected with the paper feed driving motor through the gear train, and an inner gear 157*b* disposed in a backlash groove 158 positioned in the outer gear 157*a* and fixed on the shaft 143. As is shown in FIGS. 14A and 14B, the inner gear 157*b* allows the outer gear 157*a* to idle within a predetermined angle, and thereby the outer gear 157*a* does not transmit power to the shaft 143 when the outer gear 157*a* is rotated within the predetermined angle by the paper feed driving motor, so that a leading end of paper P can be completely placed and supported in a nip between the feed roller 145 and a backup roller 146, to prevent a paper jam after the paper pickup.

The stop gear 153 is provided with a partial toothed portion 153*a* toothed within an angle, for example 90°, sufficient to open and close the paper cassette 130.

The rotating gear member 155 has: a rotating gear 155*a* installed on the shaft 143 of the pickup roller 140 to be movable between an engagement position (FIGS. 9A and 9B) engaging the stop gear 153, and a disengagement position (FIGS. 8A, 8B, 1A, and 10B) disengaged from the stop gear 153; and a pin 143*a* projected from the shaft 143 to engage with a hole 155*b* positioned in an axial direction at the rotating gear 155*a* so as to allow the rotating gear 155*a* to rotate in association with the shaft 143 of the pickup roller 140 and at the same time to move in the axial direction.

According to one aspect, the first restoring member 159 is a first compression 159 spring installed on the shaft 143, between the second hinge bracket 135*b* and the rotating gear 155*a* of the rotating gear member 155.

The actuator 160 is provided with the actuating lever 163 installed on the shaft 143 that is operated by the carrier 120, and a second restoring member 162 restoring the actuating lever 163 to an original position when a force pressed on the actuating lever 163 by the carrier 120, when the actuating lever 163 is actuated by the carrier 120, is removed. The actuating lever 163 can move in an axial direction, and at the same time, ascend into an ascent position positioned in a moving path of the carrier 120, and descend into a descent position positioned beyond the moving path of the carrier 120, between the pickup roller driving gear 157 and the rotating gear member 155.

The actuating lever 163 has the actuated projection 163*a* projected toward the paper feeding path, to engage with the corresponding actuating projection 120*a* positioned on the undersurface of the carrier 120, when the actuating lever 163 is in the ascent position. Accordingly, when the actuating lever 163 is in the ascent position and the carrier 120 is moved right or left, the actuated projection 163*a* comes in contact with the corresponding actuating projection 120*a*, and thereby the actuating lever 163 can move in association with the carrier 120.

According to one aspect, the second restoring member 162 is a second compression spring 162 disposed on the shaft 143 between the actuating lever 163 and the pickup roller driving gear 157.

At this point, it is preferable that restoring forces of the first and the second compression springs 159, 162 are determined to assure that the rotating gear 155*a* is based toward the disengaging position, (disengaged from the stop gear 153).

Also, to rotate the actuating lever 163 together with the shaft 143 when the pickup roller driving gear 157 rotates the shaft 143, the actuator 160 further includes a rubber ring 171 induced to provide a friction force to the actuating lever 163, due to the elastic forces of the first and the second compression springs 159, 162. The rubber ring 171 allows the actuating lever 163 to idle without rotating once the actuating lever 163 is rotated beyond a predetermined limit of rotation, for example 15°, when the actuating lever 163 is blocked by the frame.

A shock absorbing ring 172 is disposed between the rubber ring 171 and the rotating gear 155*a*, to absorb a shock in the axial direction generated when the actuating lever 163 is pushed toward the rotating gear 155*a*.

The cassette opening and closing unit 110 further comprises a paper presser 132, 164, 180 pressing the sheets of paper against the pickup roller 140, and allowing the pickup roller 140 to pick up the sheets of paper during the paper pickup.

The paper presser 132, 164, 180 comprises a knockup plate 132 supported in the paper receiving space 131, to ascend and descend with respect to the one end of the paper cassette 130 positioned toward the pickup roller 140; a rotating movement-transforming member 164 disposed at the frame to transform a linear movement of the actuating lever 163, which is actuated by the carrier 120 when the carrier 120 is moved in one direction, for example, in a right direction of FIG. 5 (a left direction of FIG. 6, and an upper direction of FIGS. 11A and 11B), into a rotating movement; and a linear movement-transforming member 180 transforming the rotating movement transformed by the rotating movement-transforming member 164 into a linear movement vertical to the moving direction of the carrier 120 and transmitting the transformed linear movement to the knockup plate 132.

The rotating movement-transforming member 164 is provided with: a slider 165 having a engaging projection 165*a* disposed to bar a moving path of the actuating lever 163 at a first end thereof, and first and a second sliding brackets 166*a*, 166*b* supported movably on the frame at a lower part thereof, to linearly move by the actuating lever 163; a crank 167 having a first end 167*a* disposed to be rotatable by a second end 165*b* of the slider 165, which is restored together with the actuating lever 163 when the actuating lever 163 is restored in the original position by the second restoring member 162, and a second end 167*b* twisted at a predetermined angle with respect to the first end 167*a* thereof, to rotate between an ascent position (FIG. 12*b*) and a descent position (FIGS. 8B, 9B, 10B, 11B, and 13B) when the first end 167*a* thereof is rotated; a crank extension member 169 pulling the first end 167*a* of the crank 167 to rotate in a first rotational direction, for example, an anti-clockwise direction in FIG. 6, when the slider 165 is moved in a first direction, for example, in the left direction in FIG. 6, by the actuating lever 163 which is moved in the left direction by the carrier 120; and a slider restoring member 168 restoring the slider 165 in an original position, to allow the second end 165*b* of the slider 165 to rotate the first end 167*a* of the crank 167 in a second rotational direction, i.e., in a clockwise direction in FIG. 6, when the force pressed on the actuating lever 163 is removed and thereby the actuating lever 163 is moved in a second direction, i.e., in a right direction in FIG. 6, and restored in the original position by the second compression spring 162.

According to one aspect, the crank extension member 169 comprises a first extension spring having both ends fixed respectively at a first spring fixing hanger 167*a*' positioned on the first end 167*a* of the crank 167, and a second spring fixing hanger 166*a*' positioned on the first sliding bracket 166*a* at a lower part of the slider 165. Additionally, the slider restoring member 168 comprises a third compression spring disposed on a supporting axis 174 between the second sliding bracket 166*b* and a spring support 174*a*, which is positioned on the supporting axis 174 to support the first and the second sliding brackets 166*a*, 166*b*.

The linear movement-transforming member 180 is provided with: a knockup plate driver 181 comprising a first end 181*a* supported pivotally on the frame by a hinge axis 181*a*' and a second end 181*b* having a first end surface 181*b*' and a second end surface 181*b*"; and a driver restoring member 182 lowering and restoring the knockup plate driver 181 when the second end 167*b* of the crank 167 is rotated into the descent position. The first end surface 181*b*' of the second end 181*b* projects and contacts the second end 167*b* of the crank 167 to ascend and descend together with the second end 167*b* of the crank 167 when the second end 167*b* of the crank 167 is rotated between the ascent position (FIG. 12*b*) and the descent position (FIGS. 8B, 9B, 10B, 11B, and 13B). The second end surface 181*b*" of the second end 181*b* is positioned adjacent to the knockup plate 132, opposite to the first end surface 181*b*', to raise the knockup plate 132 when the first end surface 181*b*' is raised by the second end 167*b* of the crank 167 rotating into the ascent position.

According to one aspect, the driver restoring member 182 comprises a second extension spring 182 disposed between a third spring fixing hanger (not shown) positioned on the second end 167*b* of the crank 167, and a fourth spring fixing hanger (not shown) positioned on the second end surface 181*b*" of the second end 181*b* of the knockup plate driver 181.

The cassette opening and closing unit 110 further comprises a paper separator 190 to separate and feed one sheet of paper at a time during the paper pickup.

The paper separator 190 comprises a paper separating roller 193 fixed on a shaft 194 rotatably supported at the frame, and a paper separating member 191 disposed to selectively contact the paper separating roller 193 in association with the knockup plate driver 181 when the knockup plate driver 181 selectively raises the knockup plate 130.

The paper separating member 191 is provided with a friction pad member 192 fixed pivotally on the frame at a first end 192*a* thereof and having a friction pad 196 positioned at a second end 192*b* thereof to be contactable with the paper separating roller 193, and a friction pad extension member 195 pulling the friction pad 196 toward the paper separating roller 193 to come in contact therewith, when the knockup plate driver 181 is raised.

According to one aspect, the friction pad extension member 195 comprises a third extension spring 195 having ends fixed respectively at a fifth spring fixing hanger 192*c*' positioned on a spring fixing portion 192*c* projected from the second end 192*b* of the friction pad member 192, and a sixth spring fixing hanger 181*c* positioned on the second end surface 181*b*" of the second end 181*b* of the knockup plate driver 181.

Additionally, the cassette opening and closing unit 110 further comprises a cassette opening and closing sensing part 210 to sense whether the paper cassette 130 is normally opened or closed.

The cassette opening and closing sensing part 210 comprises first and a second photo sensors 221 and 222 disposed adjacent to each other on the frame, and a sensor actuator 215 elastically and rotatably supported on the frame to be actuated by the first hinge bracket 135*a* of the supporter 135 when the paper cassette 130 is opened or closed into the paper feeding-standby position or the storing position. Each of the first and the second photo sensors 221 and 222 have a light emitting part (not shown) and a light receiving part (not shown). According to one aspect, the first and second photo sensors 221 and 222 are spaced apart.

The sensor actuator 215 is provided with: a first lever 216 having an actuating end 216*b* to turn off the first photo sensor 221 when pressed by the first hinge bracket 135*a* of the supporter 135 to block light passing between the light emitting part and the light receiving part of the first photo sensor 221, when the paper cassette 130 is rotated into the storing position; a rotating axis 217 rotatably supporting the first lever 216 on the frame; a second lever 218 projected from the rotating axis 217 to bar the paper feeding path in front of the feed roller 145 and thereby to be operable by a leading end of the paper passing through the paper feeding path, to allow the actuating end 216*b* to turn the second photo sensor 222 on and off; and a lever restoring member 223 maintaining the first lever 216 in a first position (FIG. 5) allowing light to pass between the light emitting part and the light receiving part of the first photo sensor 221 to turn on the first photo sensor 221, when the paper cassette 130 is opened into the paper feeding-standby position, and moving the first lever 216 from the first position into a second position allowing light to pass between the light emitting part and the light receiving part of the second photo sensor 222, to turn on the second photo sensor 222 when the second lever 218 is actuated by the leading end of paper.

The first lever 216 has a contacting portion 216*a*, so that it can be operated by the first hinge bracket 135*a* of the supporter 135. Also, here, the first lever 216 is explained as being operated only by the first hinge bracket 135*a* of the supporter 135, but as will be shown, the first lever 216 may be operated by other component parts of the paper cassette 130.

When the second photo sensor 222 is turned on, a controller 230 calculates how long it takes the leading end of paper to move from the second lever 218 to an entrance of the feed roller 145, and then drives the pickup roller 140 for the calculated time, that is, until the leading end of paper is curled and aligned at a nip between the feed roller 145 and the backup roller 146.

According to one aspect, the lever restoring member comprises an elastic spring disposed on the rotating axis 217 and having ends respectively supported at the frame and the first lever 216 or the second lever 218.

The cassette opening and closing sensing part 210 further comprises an alarm portion 235 to sense whether the paper cassette 130 and the first photo sensor 221 are abnormally operated due to failure or obstacle, and to convey the sensed result.

The alarm portion 235 comprises an encoder 238 disposed on the paper feed driving motor 142 to detect an amount of rotation thereof, a controller 230 calculating an amount of rotation of the paper feed driving motor 142 required to open and close the paper cassette 130 and comparing the calculated result with an operating time of the first photo sensor 221 to decide whether there is any abnormal condition, and a speaker 236 ringing an alarm and/or a display 237 displaying an alarm message according to a signal from the controller 230, when there is any abnormal condition.

The operations of the paper feeding apparatus 100 of the ink jet printer of the present invention structured above will be described with reference to FIG. 5 to FIG. 14B.

Firstly, the operation in which the paper cassette 130 opens into the paper feeding-standby position from the storing position is explained as follows.

Figure 8B:
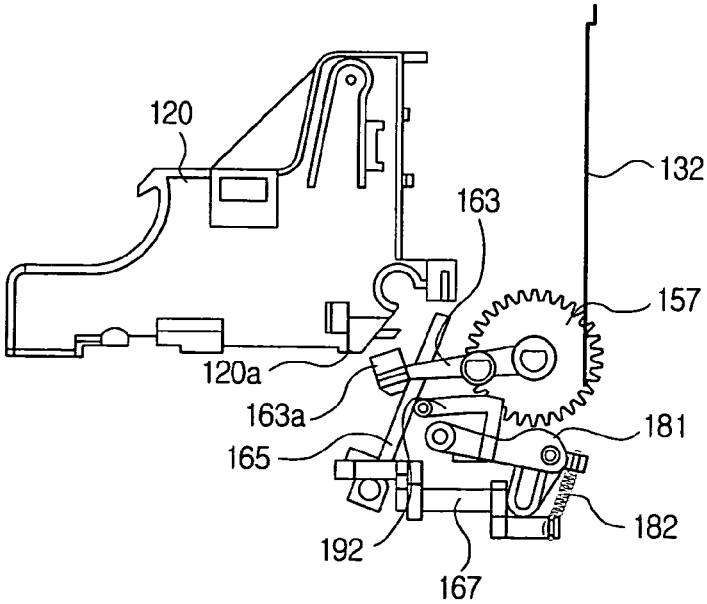
Figure 9A:
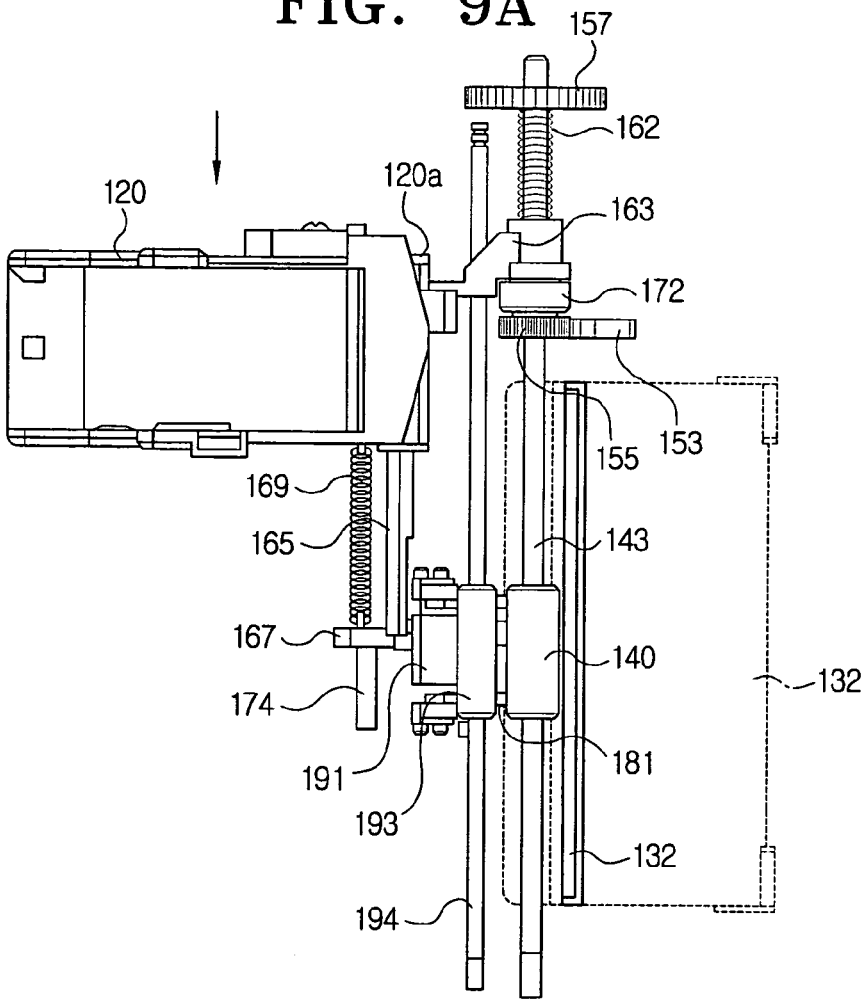

As is shown in FIG. 8B, when the printer is turned on, or a separate button (not shown) to open the paper cassette 130 is pushed, the pickup roller driving gear 157 is rotated in the anti-clockwise direction (the clockwise direction of FIG. 5 and the anti-clockwise direction of FIG. 6) by the paper feed driving motor connected thereto through the gear train.

As a result, the actuating lever 163 installed on the shaft 143 of the pickup roller 140 is rotated to the predetermined limit of rotation, for example 15°, together with the shaft 143 by the friction force between the rubber ring 171 and the actuating lever 163 generated due to the elastic forces of the first and the second compression springs of the first and the second restoring members 159 and 162, and lowered into the descent position in which the actuated projection 163*a* is positioned beyond the moving path of the carrier 120.

At this point, the actuating lever 163 is subjected to the friction force to rotate beyond 15°, but the actuating lever 163 is blocked by the frame, and rubs against the rubber ring 171 without rotating.

After that, the paper feed driving motor stops, and the carrier 120 is maximally moved in the left direction (the upper direction of FIG. 8A; the right direction of FIG. 5, or the left direction of FIG. 6), passing over the actuated projection 163*a*.

Figure 9B:
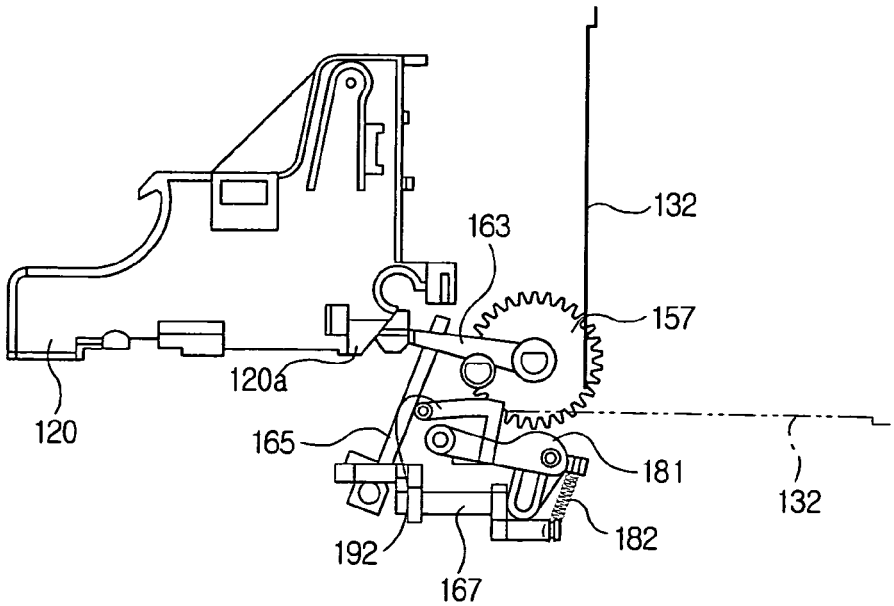

Subsequently, as is shown in FIG. 9B, the paper feed driving motor rotates in the clockwise direction (the anti-clockwise direction of FIG. 5, or the clockwise direction of FIG. 6) to raise the actuating lever 163 into the ascent position, where the actuated projection 163*a* is positioned in the moving path of the carrier 120.

After the actuated lever 163 is raised as described above, then as is shown in FIG. 9A, the carrier 120 is moved in the right direction (the lower direction of the drawing) by the carrier driving motor, and thereby the actuating lever 163 is moved in the right direction along the shaft 143 by the actuated projection 163*a*, which is engaged with the actuating projection 120*a* of the carrier 120.

As the actuating lever 163 moves in the right direction, the rubber ring 171, the shock-absorbing ring 172, and the rotating gear 155*a* of the rotating gear member 155 also move in the right direction along the shaft 143. At this time, the rotating gear 155*a* moves along the pin 143*a* positioned on the shaft 143 to transmit a rotating force of the shaft 143 to the rotating gear 155*a*.

Thereafter, when the rotating gear 155*a* is engaged with the partial toothed portion 153*a* of the stop gear 153, the carrier driving motor stops the carrier 120.

After the carrier 120 is stopped, as is shown in FIG. 9B, the pickup roller driving gear 157 is again rotated as much as 90° in the anti-clockwise direction (the clockwise direction of FIG. 5) by the paper feed driving motor, and as a result, the paper cassette 130 (only the knockup plate 132 shown) is opened into the paper feeding-standby position shown in a dotted line from the storing position shown in a solid line by the rotating force transmitted through the shaft 143, the rotating gear 155*a* and the stop gear 153.

At this point, the first hinge bracket 135*a* of the supporter 135 is separated from the first lever 216 together with the paper cassette 130, so that the actuating end 216*b* of the first lever 216 of the sensor actuator 215 is moved into the first position, (FIG. 5) to turn on the first photo sensor 221 by the elastic spring of the lever restoring member supported on the rotating axis 217.

When the first photo sensor 221 is turned on, the controller 230 calculates a time required to rotate the paper feed driving motor as much as about 90° by counting signals from the encoder installed on the paper feed driving motor, and at the same time compares whether a point of time after the first photo sensor 221 generates an ON signal coincides with a point of time after the time required to rotate the paper feed driving motor as much as about 90° has elapsed. As a result of the comparison, if they don't coincide, the controller 230 decides that the first photo sensor 221 is abnormal or the paper cassette 130 is prevented from opening by an obstacle, and rings an alarm and/or displays an alarm message through the speaker 236 and/or the display 237 of the alarm portion 235.

After the paper cassette 130 is opened as is above, then as is shown in FIG. 1A, the carrier 120 moves in the left direction (the upper direction of the drawing) by the carrier driving motor to disengage the actuating projection 120*a* from the actuated projection 163*a* of the actuating lever 163.

As a result, the rotating gear 155*a* is restored into the disengaging position, disengaged from the partial toothed portion 153*a* of the stop gear 153, by the elastic force of the first compression spring 159, and the shock-absorbing ring 172, the rubber ring 171, and the actuating lever 163 are restored into their respective original positions.

Figure 10A:
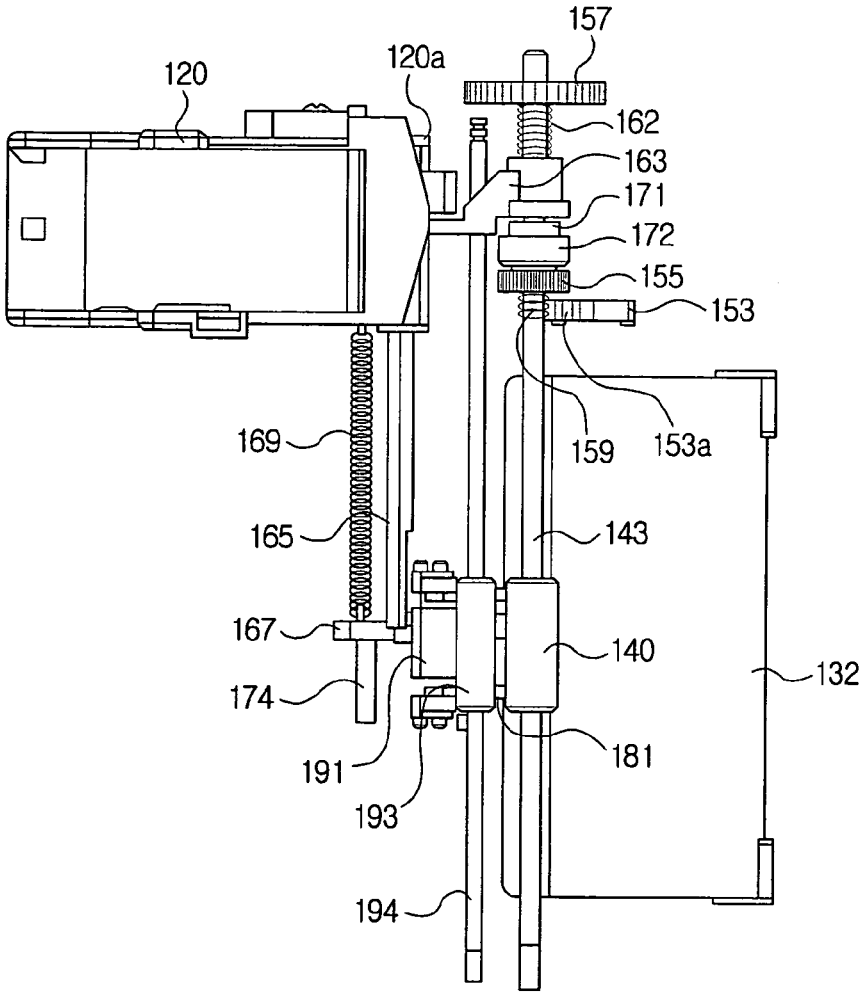
Figure 10B:
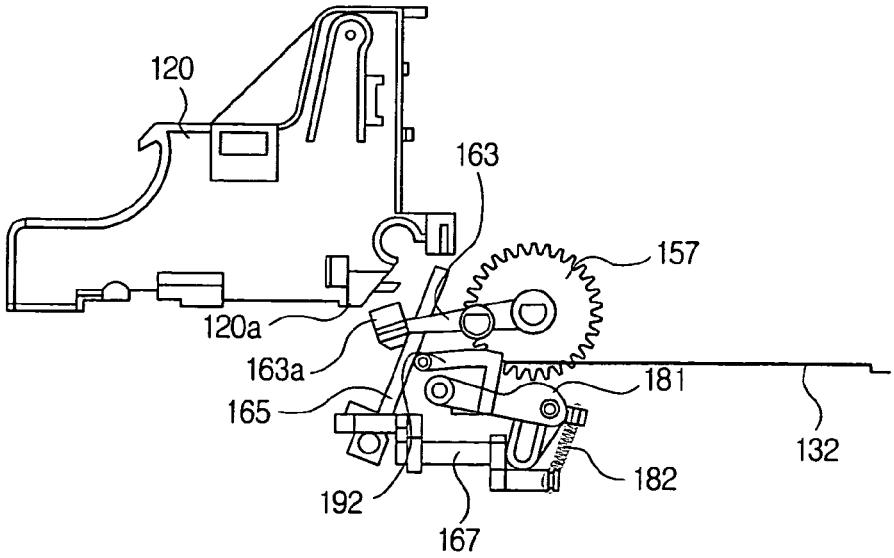

Subsequently, as is shown in FIG. 10B, the pickup roller driving gear 157 rotates in the anti-clockwise direction to lower the actuating lever 163 into the descent position, where the actuated projection 163*a* thereof is positioned beyond the moving path of the carrier 120.

After the actuating lever 163 is lowered into the descent position, the carrier 120 is moved in the right direction (the lower direction of the drawing), passing over the actuated projection 163*a* of the actuating lever 163, by the carrier driving motor, to stand by for the paper pickup operation.

Figure 11A:
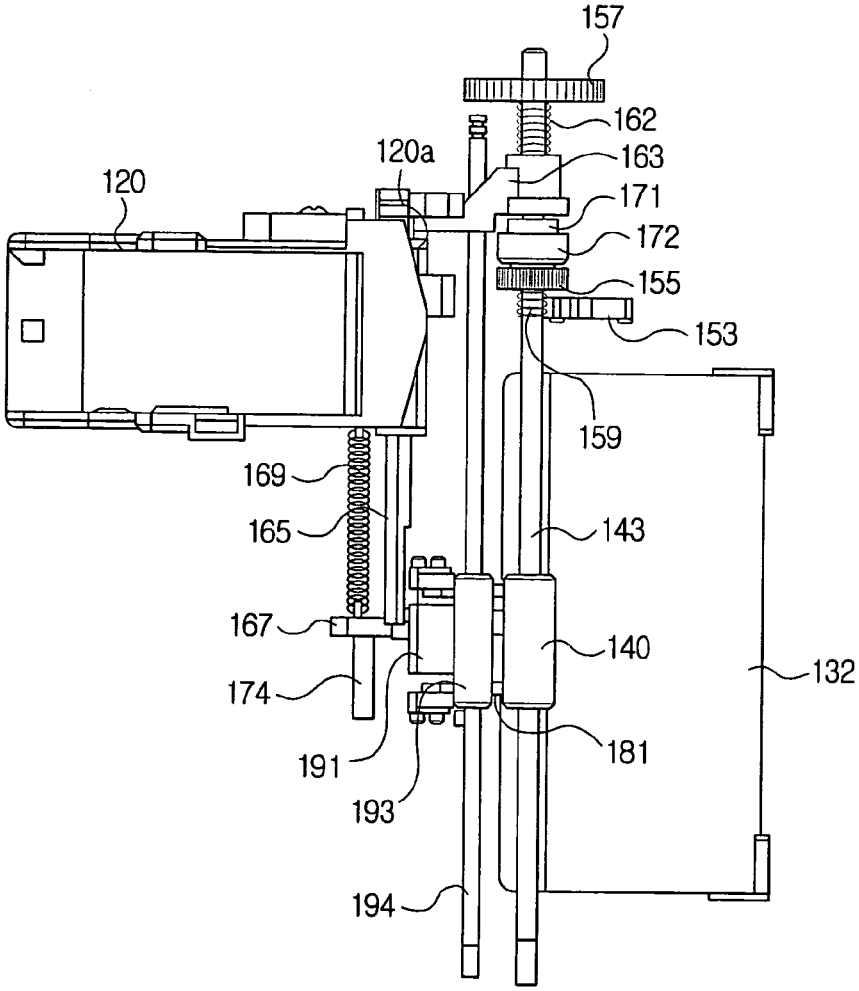
FIGS. 11A, 12A, 13A, are top plan views, illustrating a paper pickup operation of the paper feeding apparatus of FIG. 5, and FIGS. 11B, 12B, and 13B, are left side elevation views corresponding to the respective top plan views of FIGS. 11A, 12A, 13A.
Figure 11B:
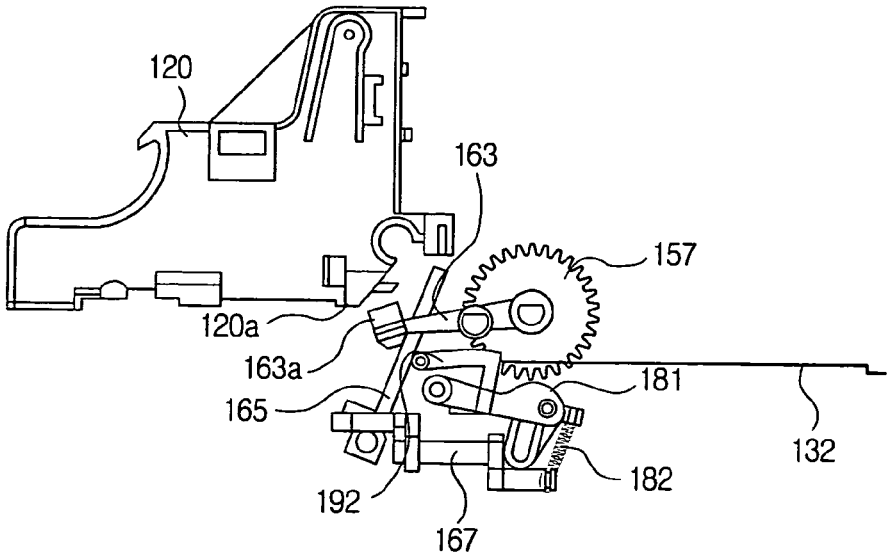

In the paper pickup operation, as is shown in FIG. 11A, the actuating projection 120*a* of the carrier 120 is positioned to the right of the actuated projection 163*a* of the actuating lever 163, that is, at the lower side of the drawing, when the pickup roller driving gear 157 rotates in the clockwise direction (the anti-clockwise direction of FIG. 6) to raise the actuating lever 163 into the ascent position as explained above.

Figure 12A:
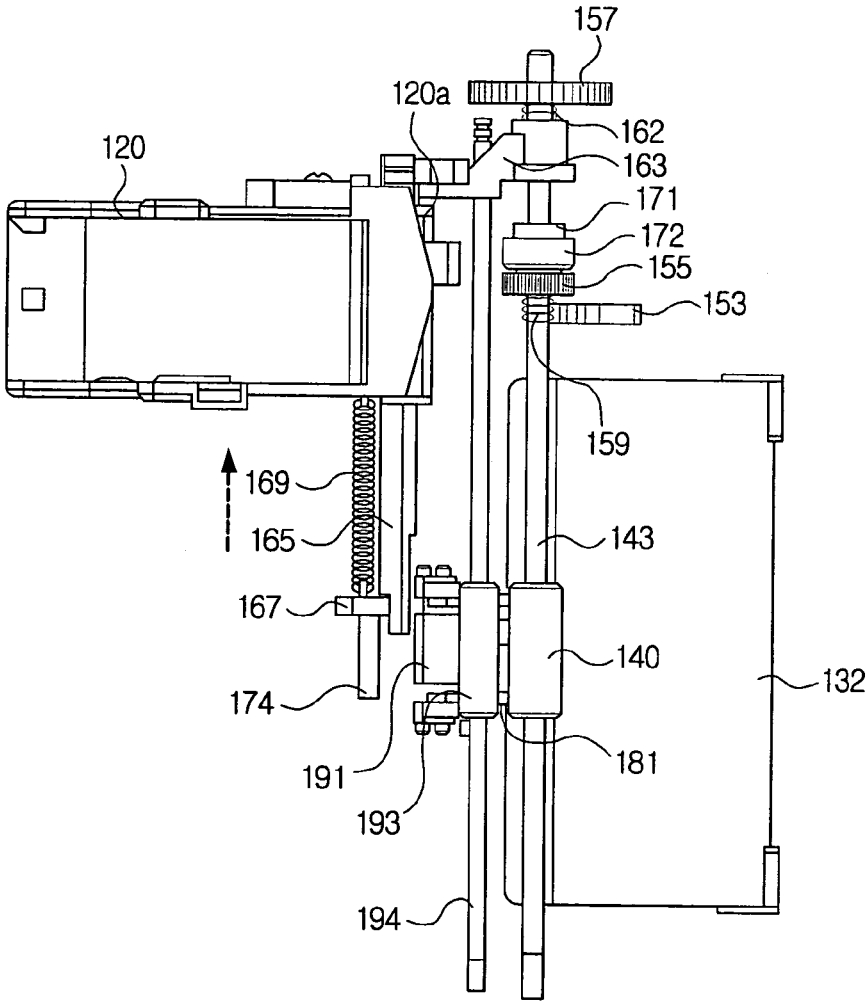

After the actuating lever 163 is raised into the ascent position, as is shown in FIG. 12A, the carrier 120 is moved in the left direction by the carrier driving motor, and thereby the actuating lever 163 is also moved in the left direction by the actuated projection 163*a*, which is engaged with the actuating projection 120*a* of the carrier 120.

As the actuating lever 163 moves in the left direction, the first end 165*a* of the slider 165, which is installed to move in association with the actuating lever, 163 is pushed in the left direction, so that the slider 165 is moved in the left direction along the supporting axis 174 via the first and second sliding brackets 166*a* and 166*b*, against the elastic force of the slider restoring member 168.

At this point, as is shown in FIG. 6, the crank extension member 169, disposed between the first sliding bracket 166*a* and the first end 167*a* of the crank 167, pulls the first end 167*a* of the crank 167 in the left direction, that is, in the upper direction of FIG. 12A, to rotate the crank 167 in the anti-clockwise direction, and thereby rotate the second end 167*b* when the first end 167*a* rotates into the ascent position.

As the second end 167*b* of the crank 167 rotates into the ascent position, the knockup plate driver 181 is raised by the first end surface 181*b*' of the second end 181*b* coming in contact with the second end 167*b* of the crank 167.

Figure 12B:
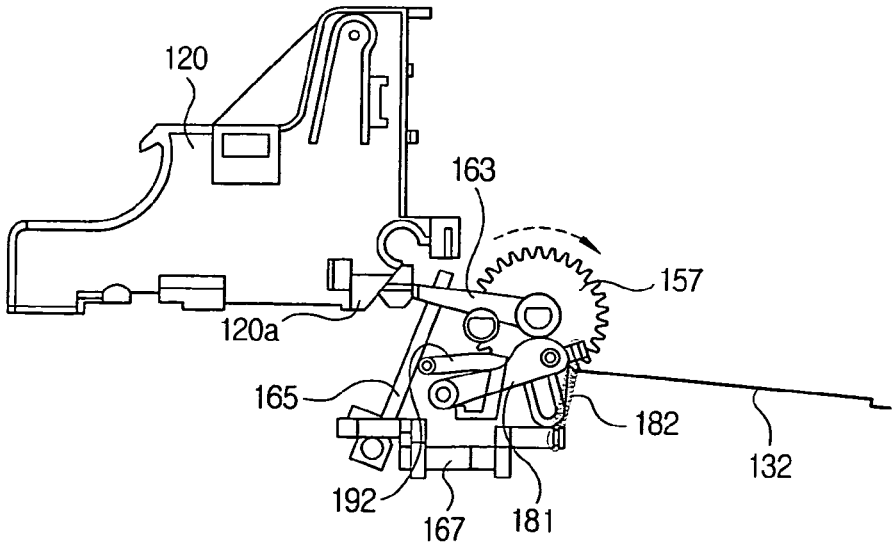

Accordingly, as is shown in FIG. 12B, the knockup plate 132, which is in contact with the second end surface 181*b*" of the second end 181*b* of the knockup plate driver 181 is lifted upwardly to assure that the sheets of paper stacked thereon come in contact with the pickup roller 140.

At this time, the friction pad member 192 of the paper separating member 191 is raised together with the knockup plate driver 181 by the friction pad extension member 195 (which is installed between the spring hanging portion 192*c* and the second end surface 181*b*" of the knockup plate driver 181), and the friction pad 196 contacts the paper separating roller 193 with a predetermined pressure.

After that, as is shown in FIG. 14A, the pickup roller driving gear 157 rotates in the anti-clockwise direction (the clockwise direction of FIG. 6 or FIG. 12B) to pick up the sheets of paper, so that the pickup roller 140 picks up one sheet of paper at a time and feeds the paper through a nip between the friction pad 196 and the paper separating roller 193 of the paper separating member 191.

At this point, as the paper P pushes the second lever 218 of the sensor actuator 210 in front of the feed roller 145, the actuating end 216*b* of the first lever 216, positioned in the first position of turning on the first photo sensor 221, moves into the second position to turn on the second photo sensor 222.

Accordingly, the controller 230 calculates how long it takes the leading end of paper to move from the second lever 218 to the entrance of the feed roller 145 in response to a signal from the second photo sensor 222, and then drives the pickup roller 140 for the calculated time, that is, until the leading end of paper is curled and aligned at the nip between the feed roller 145 and the backup roller 146.

After the paper P is picked up by the pickup roller 140 as described above, the pickup roller driving gear 157 is rotated through the predetermined angle from a state shown in FIG. 14A by the paper feed driving motor, and thereby the leading end of paper P is completely placed and supported in the nip between the feed roller 145 and the backup roller 146, to prevent a paper feeding failure, such as a paper jam.

At this point, even though the outer gear 157*a* of the pickup roller driving gear 157 rotates in the predetermined angle, it does not transmit the power of the paper feed driving motor to the shaft 143 of the pickup roller 140, but rather, idles through the predetermined angle until it comes in contact with the inner gear 157*b* disposed in the backlash groove 158. Accordingly, the power of the paper feed driving motor is not transmitted to the shaft 143 of the pickup roller 140, but only to the feed roller 145.

Thus, as shown in FIG. 14B, the paper P does not come out from between the feed roller 145 and the backup roller 146, but remains therebetween.

Figure 13A:
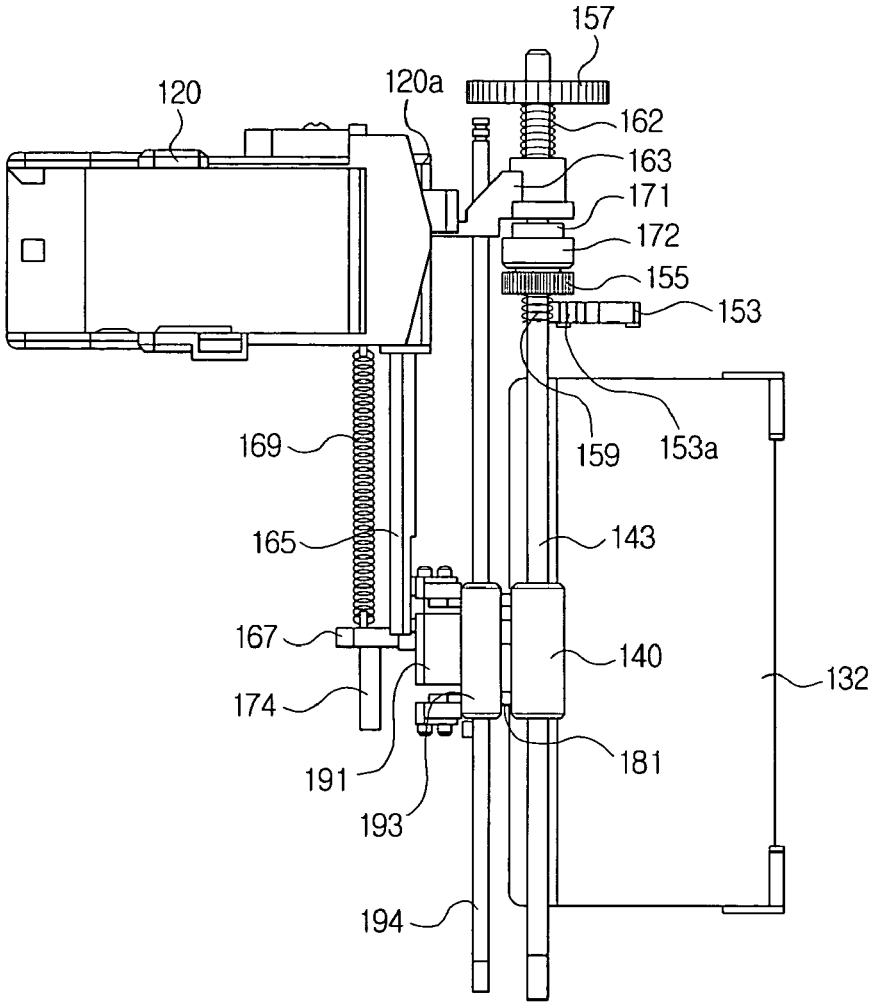

After that, as is shown in FIG. 13A, the carrier 120 moves in the right direction, that is, in the lower direction of the drawing, to disengage the actuating projection 120*a* from the actuated projection 163*a* of the actuating lever 163, and thereby the actuating lever 163 and the slider 165 are respectively moved in the right direction by the elastic force of the second restoring member 162 and the slider restoring member 168, to return to their respective original positions.

When the slider 165 is returning in the lower direction (the right direction of FIG. 6) as is above, the second end 165*b* of the slider 165 pushes the first end 167*a* of the crank 167 to rotate the crank 167 in the clockwise direction, so that the second end 167*b* of the crank 167 is rotated into the descent position.

As the second end 167*b* of the crank 167 rotates into the descent position, the knockup plate driver 181 is lowered by the first end surface 181*b*' of the second end 181*b*, which is in contact with the second end 167*b* of the crank 167.

Figure 13B:
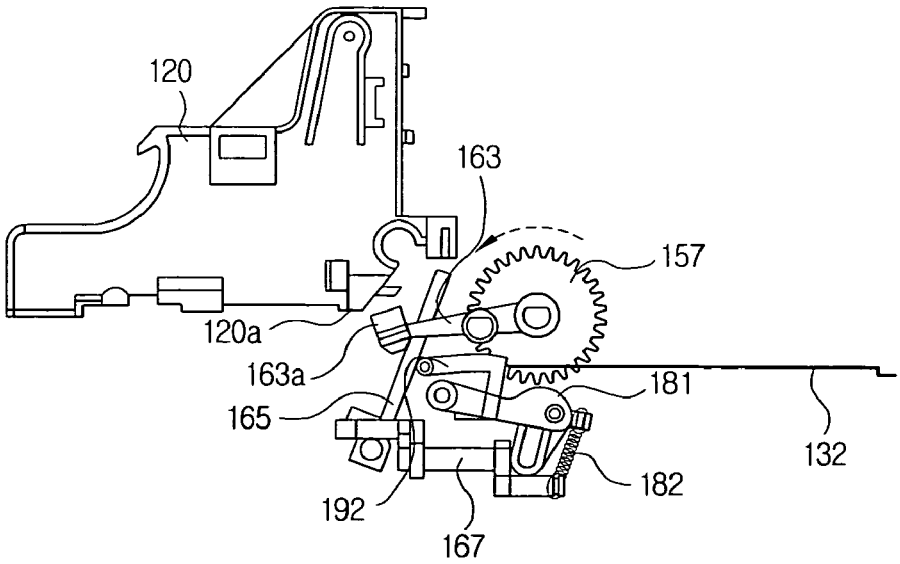

Accordingly, as is shown in FIG. 13B, the knockup plate 132, which is in contact with the second end surface 181*b*" of the second end 181*b* of the knockup plate driver 181, is lowered to allow the sheets of paper stacked thereon to cease contacting the pickup roller 140.

At this time, since the extension force of the friction pad extension member 195 is not being exerted due to the lowering of the knockup plate driver 181, the friction pad member 192 of the paper separating member 191 s lowered, and the friction pad 196 separates from the paper separating roller 193.

Subsequently, the paper feed driving motor rotates the pickup roller driving gear 157 in the anti-clockwise direction of FIG. 13B (the clockwise direction of FIG. 5, FIG. 14A or FIG. 14B), to drive the feed roller 145.

At this point, since the paper P is separated from the pickup roller 145 because the knockup plate 132 is positioned in the descent position, the pickup roller 145 is idled, and the paper P is transported into the printing area under the nozzle of the print head of the ink cartridge by the feed roller 145.

When the paper P arrives at the printing area under the nozzle of the print head, the carrier 120 is moved right and left, jetting ink through the nozzle of the print head of the ink cartridge to perform the printing operation.

After the printing operation, the paper P is discharged through a discharging roller and a backup roller (not shown).

Thereafter, when the use of the printer comes to an end, the paper cassette 130 is closed into the storing position by turning off the printer or pushing a separate button (not shown) for closing the paper cassette 130. At this point, the paper cassette 130 is closed in a state having the sheets of paper stacked thereon.

The operation of closing the paper cassette 130 into the storing position is performed in the same manner as the operation of opening the paper cassette 130 into the paper feeding-standby position explained with reference to FIGA 8A through 10B, except that after the rotating gear 155*a* is engaged with the partial toothed portion 153*a* of the stop gear 153, the pickup roller driving gear 157 is rotated about 90° in the clockwise direction (the anti-clockwise direction of FIG. 5) by the paper feed driving motor, to close the paper cassette 130. Thus, the paper cassette 130 is rotated from the paper feeding-standby position shown in the dotted line to the storing position shown in the solid line of FIG. 9B by the rotation force transmitted through the shaft 143, the rotating gear 155*a* and the stop gear 153. After the operation of closing the paper cassette 130 is completed, the carrier 120 is moved in the right direction to return into a home position.

As is apparent from the foregoing description, it can be appreciated that the paper feeding apparatus 100 of the image forming device is capable of automatically opening the paper cassette 130 into the paper feeding-standby position when the image forming device is used, and automatically closing the paper cassette 130 into the space-minimized position when the image forming device is not in use, thereby accommodating the user and minimizing the space occupied by the image forming device.

Further, in the paper feeding apparatus 100 of the image forming device, the paper cassette 130 is closed in a state having the sheets of paper stacked thereon, so that there is no need to store the sheets of paper separately.

Furthermore, in the paper feeding apparatus 100 of the image forming device, when the feed roller 145 feeds the sheet of paper, the pickup roller 140 is maintained apart from the sheet of paper, so that a load pressed on a rear end of the paper by the pickup roller during printing is removed, and thus a quality in printing of the rear end of the paper is enhanced.

Also, the paper feeding apparatus 100 of the image forming device can sense, by using the existing sensors, whether the paper cassette is opened or closed, thereby preventing a fabrication cost from being increased due to the use of additional sensors.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper feeding apparatus of an image forming device, comprising:

a frame constituting a main body;

a paper feeder rotatably disposed with respect to the frame to stack sheets of paper;

a transporting unit having a pickup roller to pick up a sheet of paper stacked in the paper feeder, and a feed roller to transport the sheet of paper picked up by the pickup roller; and a feeder opening and closing unit automatically rotating the paper feeder between a storage position and a paper feeding-standby position employing a driving source driving the transporting unit, the storage position being a position where the paper feeder is in close contact with the frame to minimize an installation space therefor, and the paper feeding-standby position being a position where the paper feeder is separated from the frame to allow the sheet of paper to be picked up by the pickup roller, wherein the feeder opening and closing unit comprises at least one hinge bracket rotatably connecting the paper feeder to a pickup roller shaft, on which the pickup roller is installed.

2. The paper feeding apparatus according to claim 1, wherein the feeder opening and closing unit comprises:

an actuator to selectively employ the driving source.

3. The paper feeding apparatus according to claim 2, wherein the feeder opening and closing unit further comprises:

a pickup roller driving gear disposed on the pickup roller shaft and having a backlash groove, and an inner gear installed to rotate within the backlash groove, allowing the pickup roller shaft to rotate within a first predetermined range without transferring power to the pickup roller;

a stop gear positioned at the hinge bracket;

a rotating gear member disposed on the pickup roller shaft, selectively engaging the stop gear to move the paper feeder between the storage and paper feeding positions; and a first restoring member to bias the rotating gear member to be disengaged from the stop gear.

4. The paper feeding apparatus according to claim 3, wherein:

the first restoring member is a spring.

5. The paper feeding apparatus according to claim 3, wherein:

only a portion of the stop gear has teeth.

6. The paper feeding apparatus according to claim 3, wherein the rotating gear member comprises:

a pin positioned on the pickup roller shaft; and a rotating gear disposed on the pickup roller shaft, movable between being engaged with the stop gear and being disengaged with the stop gear, and having a hole positioned axially, enabling the rotating gear to rotate with and move along the pickup roller shaft, when the pin is engaged with the hole.

7. The paper feeding apparatus according to claim 3, wherein the actuator comprises:

an actuating lever, disposed on the pickup roller shaft between the pickup roller driving gear and the rotating gear member, and movable along the pickup roller shaft, and movable between a position in a path of a carrier, and a position beyond the path of the carrier a second restoring member, biasing the actuating lever to an original position when the carrier is not exerting a force on the actuating lever, the carrier exerting the force on the actuating lever by moving and contacting the actuating lever while the actuating lever is in the position in the path of a carrier; and a rubber ring enabling the actuating lever to idle without rotating once the actuating lever is rotated beyond a second predetermined range.

8. The paper feeding apparatus according to claim 7, wherein:

the second restoring member is a spring.

9. The paper feeding apparatus according to claim 7, wherein:

the second predetermined range is 15°.

10. The paper feeding apparatus according to claim 2, wherein the feeder opening and closing unit further comprises:

a knockup plate disposed in the paper feeder to move paper stored in the paper feeder toward the pickup roller;

an actuating lever movably disposed on the pickup roller shaft;

a rotating movement-transforming member disposed on the main body, transforming a linear movement of the actuating lever when moved by a carrier into a rotating movement, the carrier moving along a shaft disposed in the frame; and a linear movement-transforming member transforming the rotating movement into a linear movement perpendicular to a moving direction of the carrier, and transmitting the transformed linear movement to the knockup plate.

11. The paper feeding apparatus according to claim 10, wherein the rotating movement-transforming member comprises:

a slider having an engaging projection at a first end to restrict a moving path of the actuating lever, and at least one sliding bracket supported movably on the main body;

a crank having a first end rotatable by a second end of the slider when the actuating lever is restored into its original position by a restoring member, and a second end rotating between first and second positions when the first end thereof is rotated;

a crank extension member to rotate the first end of the crank in a first rotational direction when the slider is moved in a first direction by the actuating lever; and a slider restoring member to bias the slider toward an original position to rotate the first end of the crank in a second rotational direction when the actuating lever is moved to the original position.

12. The paper feeding apparatus according to claim 11, wherein:

the slider restoring member is a spring.

13. The paper feeding apparatus according to claim 11, wherein the linear movement-transforming member comprises:

a knockup plate driver having a first end supported pivotally on the main body, and a second end with a first end surface contacting the second end of the crank and moving between first and second knockup plate driver positions when the second end of the crank respectively rotates between the first and second positions, and a second end surface positioned opposite to the knockup plate at an opposite side of the first end surface to move the knockup plate toward the pickup roller when the first end surface moves to the first knockup plate driver position; and a driver restoring member to move the knockup plate driver to the second knockup plate driver position when the second end of the crank is rotated into the second position.

14. The paper feeding apparatus according to claim 13, wherein:

the driver restoring member is a spring.

15. The paper feeding apparatus according to claim 13, wherein the feeder opening and closing unit further comprises:

a paper separating roller rotatably supported on the main body; and a paper separating member contacting the paper separating roller when the first end surface of the second end of the knockup plate driver moves to the first knockup plate driver position.

16. The paper feeding apparatus according to claim 15, wherein the paper separating member comprises:

a friction pad member rotatably disposed on the main body and having a friction pad positioned to contact the paper separating roller; and a friction pad extension member to bias the friction pad member toward the paper separating roller when the knockup plate is moved toward the pickup roller.

17. The paper feeding apparatus according to claim 2, wherein the feeder opening and closing unit further comprises:

a first photo sensor having a light emitting part and a light receiving part disposed on the main body; and a sensor actuator elastically and rotatably disposed on the main body, actuated by one of the paper feeder or the at least one hinge bracket, when the paper feeder is moved into one of the storage position or the paper feeding position.

18. The paper feeding apparatus according to claim 17, wherein the sensor actuator comprises, a first lever, actuated to interfere between the light emitting part and the light receiving part of the first photo sensor and turn off the first photo sensor when the paper feeder is moved into the storage position;

a rotating axis rotatably disposing the first lever on the main body; and a lever restoring member biasing the first lever to not interfere between the light emitting part and the light receiving part of the first photo sensor, to turn on the first photo sensor when the paper feeder is moved into the paper feeding position.

19. The paper feeding apparatus according to claim 18, wherein:

the lever restoring member is a spring.

20. The paper feeding apparatus according to claim 18, wherein:

the feeder opening and closing unit further comprises a second photo sensor having a light emitting part and a light receiving part, actuated by the first lever; and the sensor actuator further comprises a second lever, projecting from the rotating axis into a paper feeding path, and actuated by a leading end of the paper passing through the paper feeding path to actuate the first lever, wherein the second photo sensor is one of disposed adjacent to the first photo sensor or spaced-apart from the first photo sensor.

21. The paper feeding apparatus according to claim 18, wherein the feeder opening and closing unit further comprises:

an alarm portion to sense abnormal operation of the paper feeding apparatus and at least one of display an error message or sound an alarm.

22. The paper feeding apparatus according to claim 21, wherein the alarm portion comprises:

an encoder disposed at the driving source, to detect an amount of rotation of the driving source;

a controller to compare an amount of rotation of the driving source required to open and close the paper feeder with an operating time of the first photo sensor to determine whether there is an abnormal condition; and at least one of a speaker to sound the alarm, or a display to display the alarm message if the abnormal condition exists.

23. A paper feeding apparatus of an image forming device, comprising:

a frame constituting a main body;

a paper feeder rotatably disposed with respect to the frame to stack sheets of paper and to move between a storage position and a paper feeding position;

a transporting unit having a pickup roller to pick up a sheet of paper stacked in the paper feeder, and a feed roller to transport the sheet of paper picked up by the pickup roller;

an actuator disposed with respect to a pickup roller shaft, on which the pickup roller is installed, and moving the paper feeder between the storage position and the paper feeding position; and a carrier, engaging the actuator to allow a driving source that drives the pickup roller and the feed roller to selectively transmit a driving source thereof to the actuator through the pickup roller shaft to automatically move the paper feeder between the storage position and the paper feeding position, and engage a movement-transforming member transforming linear motion in a first direction to linear motion in a second direction perpendicular to the first direction and transmitting a force to a knockup plate to move the knockup plate to move the paper toward the feed roller, the movement-transforming member being positioned opposite to the knockup plate.

* * * * *

UNITED STATES PATENT AND TRADEMARK OFFICE

CERTIFICATE OF CORRECTION

PATENT NO. : 7,100,915 B2
APPLICATION NO. : 10/757997
DATED : September 5, 2006
INVENTOR(S) : Yong-duk Lee et al.

It is certified that error appears in the above-identified patent and that said Letters Patent is hereby corrected as shown below:

Column 13, Line 51, after “the carrier” insert --,--.

Column 15, Line 26, change “comprises,” to --comprises:--.

Signed and Sealed this

Thirteenth Day of February, 2007

JON W. DUDAS
*Director of the United States Patent and Trademark Office*